US005366575A

United States Patent [19]

Staff et al.

[11] Patent Number: 5,366,575

[45] Date of Patent: Nov. 22, 1994

[54] PERMANENT MARKING ARTICLE AND METHOD OF APPLICATION

[75] Inventors: Karen E. Staff, Cedar Park, Tex.; James M. Scott, Jacksonville, Fla.

[73] Assignee: Minnesota Mining and Manufacturing Company, St. Paul, Minn.

[21] Appl. No.: 925,571

[22] Filed: Aug. 4, 1992

[51] Int. Cl.[5] ..... B31C 13/00

[52] U.S. Cl. ..... 156/185; 428/195; 428/349; 428/46; 428/913; 428/81; 156/294; 156/173; 156/187; 156/182; 156/149; 156/212; 156/303.1; 156/165; 156/244.24

[58] Field of Search ..... 428/195, 349, 46, 913, 428/36, 81; 156/294, 173, 187, 182, 149, 212, 303.1, 165, 244.24, 185

[56] References Cited

U.S. PATENT DOCUMENTS

| | | | |
|---|---|---|---|
| 3,006,463 | 10/1961 | Bond et al. | 206/59 |
| 3,470,127 | 9/1969 | Snell et al. | 260/33.6 |
| 3,684,644 | 8/1972 | Snell | 161/165 |
| 3,725,330 | 4/1973 | Shirato et al. | 260/33.6 |
| 4,579,759 | 4/1986 | Breuers | 428/36 X |
| 4,693,920 | 9/1987 | Argarwal et al. | 428/40 |
| 4,713,133 | 12/1987 | Kent | 156/162 |
| 4,925,715 | 5/1990 | Sato | 428/220 |
| 5,176,948 | 1/1993 | Nguyen et al. | 428/195 |

FOREIGN PATENT DOCUMENTS

| | | |
|---|---|---|
| 0027026 | 9/1980 | European Pat. Off. . |
| 0166624 | 6/1985 | European Pat. Off. . |
| 3422511A1 | 9/1985 | Germany . |

*Primary Examiner*—W. Gary Jones
*Assistant Examiner*—Mark DeSimone
*Attorney, Agent, or Firm*—Gary L. Griswold; Walter N. Kirn; David W. Anderson

[57] ABSTRACT

A permanent marking article for use with an elongate object, consisting of a strip of transparent polymeric film having an upper and a lower surface, at least a portion of the upper surface being imprintable, the polymeric film being fusible to itself with the passage of time, and remaining transparent even after fusion such that any marking placed on any. portion of the article remains readable even if covered by one or more overwrapping portions of the strip.

7 Claims, 1 Drawing Sheet

PERMANENT MARKING ARTICLE AND METHOD OF APPLICATION

FIELD OF THE INVENTION

The present invention relates to the identification of elongate objects using indicia wherein the indicia is both rendered permanent and protected using an optically clear means of attachment.

DESCRIPTION OF THE RELATED ART

It is frequently necessary to identify components in electrical assemblies, particularly where a multiplicity of wires and/or cables need to be identified. Various marking systems for wire cables and the like are known in the art.

Wires and cables have been identified by impressing characters directly into the insulation surrounding the wire. This has the disadvantage off possible damage to the insulation which may compromise its insulative properties. Early attempts to create permanent marking assemblies employed plastic tubes which slip over the cable. These may be loose or may use heat-shrink technology as disclosed in U.S. Pat. No. 3,894,731. However, these assemblies must be applied during installation, since they must be slipped onto an unterminated wire. This prevents any marking of already installed cable, or redesignation of previously marked cables.

Later, heat-shrink sleeves were formed as wrap-around versions, which employed strips of heat-shrink film. However, both tubular and wrap-around shrink sleeves employ radial shrinkage which distorts any indicia applied to the sleeve for identification purposes.

U.S. Pat. No. 4,569,759 discloses an adhesive tape construction used for identification markers to be applied to wires, cables or switch structures. A pressure-sensitive adhesive layer is applied to the lower surface of a transparent substrate, which has an opaque ink-receptive area on the surface opposite the adhesive. The tape is cut into individual strips which are adhesively attached side-by-side on a release carrier material. The information is inscribed on the ink-receptive area. The marker strip is then removed from the release liner by peeling back the tape, and applied by attaching the head section to the wire and wrapping it upon itself so that the width dimension of the tape becomes the length of the marker. Multiple layers of strips may be arranged upon one another.

U.S. Pat. No. 4,465,717 discloses a means for marking elongate objects in which a carrier supports a strip of marking material consisting of a heat-shrink film coated with a heat-reactive adhesive. Two stripes of pressure-sensitive adhesive are applied to the heat-reactive adhesive. Indicia is then applied to the strip on the surface opposite to that having the adhesive. The marker is applied temporarily via the pressure-sensitive adhesive. Permanent attachment is achieved by applying heat which activates the heat-reactive adhesive and shrinks the sleeve.

U.S. Pat. No. 4,246,709 discloses a holder for an identification sheet which comprises two transparent films bonded by their side edges. When heated, the composite curls relative to an axis transverse to the length of the film. For use, identification is added as a sheet between the two films. The composite is then applied and heated, whereupon it curls around the wire until it conforms. A hot-melt adhesive may be used to attach the identification permanently to the wire.

It has now been discovered that a marking article may be formed via wrap-around techniques to provide a permanent marker. This marker is flag-free in that the terminal end of the marking article does not unwind, and has permanent readability due to protection afforded by an optically clear wrap of the article.

Further, because the polymeric film used in the article is dimensionally stable, the imprinted area does not suffer from distortion of the markings thereon.

SUMMARY OF THE INVENTION

The invention provides an identification system for the marking of elongate objects such as pipes or electrical wires. The identification mark is displayed on a strip of material which is positioned by wrapping it around the elongate object.

Specifically, the invention provides a permanent marking article for use with an elongate object, comprising a sheet of transparent polymeric film having an upper and a lower surface, at least a portion of the upper surface being imprintable, said polymeric film being fusible to itself with the passage of time and remaining transparent even after fusion such that any marking placed on any portion of the article remains readable even if covered by one or more overwrapping portions of said sheet.

Preferred marking articles of the invention comprise a sheet of transparent EPDM or silicone film having an upper and a lower surface, a portion of the upper surface being coated with an opaque, imprintable layer, said transparent polymeric film extending beyond said opaque layer such that a portion of the sheet appears opaque, and a portion of the sheet appears transparent, said polymeric film being fusible to itself with the passage of time, said polymeric film remaining transparent even after fusion such that any marking placed on said opaque layer remains readable even if covered by one or more overwrapping portions of said strip.

The invention also provides a final marked elongate object having a tubular permanent marking article positioned longitudinally around said elongate object, said article consisting of a plurality of overwraps and an imprinted area, said overwraps having been fused to themselves by the passage of time, the imprinted area being clearly readable both before and after fusion. Further, there is no distortion of the polymeric film caused by changes in dimension as the products are dimensionally stable before and after fusion. A method of applying the article to an object is also disclosed.

As used herein, the following terms have the indicated definitions.

1. The term "wrap" means a sufficient length of polymeric sheet applied such that it has wound around the elongate object one time.

2. The term "overwrap" means any wrap after the first.

3. The term "imprintable" means capable of permanently retaining writing or typing thereon.

4. The term "readable" means easily discernable, and not exhibiting excess distortion.

5. The term "self-adherence" means capable of sticking to another similar surface with finger pressure, either due to an inherent property of the surface or a coating thereon.

BRIEF DESCRIPTION OF THE DRAWINGS

The present invention will be more thoroughly described with respect to the accompanying drawings, wherein like numbers refer to like parts in the several views, and wherein.

DETAILED DESCRIPTION OF THE INVENTION

Figure 1:
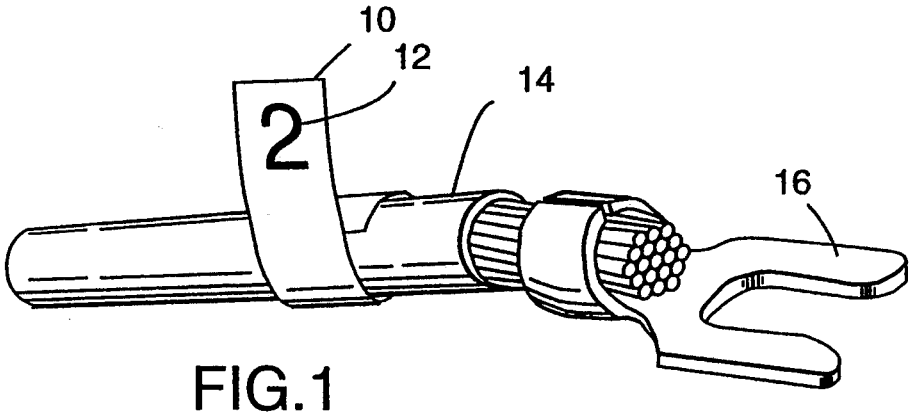
FIG. 1 is a perspective view of a polymeric sheet of the invention bearing indicia and in the process of being applied to an object to be identified.

FIG. 1 illustrates a polymeric sheet 10 bearing indicia 12 in the process of being applied to an object 14. The object 14 illustrated is an electrical wire terminating in a crimp terminal 16. The object 14 could be any object around which it is capable of wrapping a sheet 10 of the invention such that the sheet 10 contacts itself. The intended and anticipated use of the sheet 10, however, is application to, and thus the marking of, cylindrical objects such as electrical wire or cable or pipe.

The polymeric sheet 10 of the present invention is thus referred to as an identification marker 10 which is unique in that it is capable of fusion to itself with the passage of time so that the marker 10 becomes one solid, tubular piece of material and thus cannot unwrap from the identified object 14. In fact, after fusion to itself, the marker 10 can only be removed by destroying the marker 10. The advantages of the present marker 10 are that it may be applied to any portion of the object 14 by wrapping like a tape, it is repositionable after application since it does not adhere to most substrates and, as stated, it becomes a permanent marker 10 after fusion to itself with the passage of time. Thus the marker 10 of the invention is superior to tape in that the marker 10, after fusion, cannot unwind due to the failure of adhesion to itself, and is not adhered to the object 14 so it may be repositioned after attachment. The marker 10 is superior to pre-formed, tubular markers in that the marker 10 may be applied to any portion of an object 14 and does not require that an end of the object 14 be available to accept the marker 10. Also, unlike pre-formed, tubular markers, the present invention does not require the application of heat to locate the marker on the object. Thus the marker 10 of the invention exhibits the individual advantages of tape and tubes as markers, while eliminating their disadvantages.

The successful use of identification markers 10 of the present invention depends upon careful selection of polymeric substrates. These substrates must be transparent films which will self-adhere to remain in position until the substrates self-fuse to produce the desired structure. Preferably the substrate is a rectangular sheet of film which may be rolled along its length to form a tubular structure. The wall thickness of the tubular structure is determined by the number of overwraps which are produced by the rolling of the rectangle. With the passage of time, the overwraps must fuse together to form a clear transparent polymeric tube. The outer surface of the tube will ideally be smooth and seam-free. In practice, however, a slight seam is usually visible at the sheet end.

Materials useful for the substrate of the invention thus are those polymeric films which are transparent, dimensionally stable and self-fuse with the passage of time. Preferred suitable polymers include EPDM, self-fusing silicone gum and suitable mixtures thereof. Specific base materials may include a self-fusing silicone gum which is partially cured; a formulation consisting mainly of self-fusing silicone gum and EPDM, wherein the silicone portion is fully cured and the EPDM portion is uncured or partially cured; a formulation consisting mainly of a self-fusing silicone gum and a non-reactive silicone gum, wherein the self-fusing gum is fully cured and the non-reactive gum remains uncured; a mixture of EPDM and liquid EPDM, wherein the liquid EPDM may be cured; liquid EPDM and self-fusing silicone gum, wherein the silicone gum may be cured; EPDM and liquid nitrile, wherein the liquid nitrile may be cured; nitrile and a mixture of EPDM and a thermoplastic such as polyethylene or polypropylene, wherein the EPDM may be cured. Specific formulations which have been found to exhibit the desired properties are:

EXAMPLE 1

| Trade Name | Generic Identification | % by weight | Manufacturer |
|---|---|---|---|
| C525U | silicone | 24.72 | Wacker Silicones Corp. |
| SE 1067U | silicone | 24.72 | General Electric Silicones |
| SE 6160 | silicone | 49.43 | General Electric Silicones |
| STI-T | peroxide | 0.89 | Dow Corning |
| Dicup R | peroxide | 0.25 | Hercules |

EXAMPLE 2

| Trade Name | Generic Identification | % by weight | Manufacturer |
|---|---|---|---|
| Vistanex L120 | polyisobutylene | 20.60 | Exxon Chemicals |
| Nordel 1070 | EPDM | 20.60 | DuPont |
| | zinc stearate | 0.21 | |
| Plasthall DOZ | plasticizer | 3.29 | C. P. Hall Co. |
| Plasthall DIDG | plasticizer | 3.29 | C. P. Hall Co. |
| Cabosil M-5 | silica filler | 25.18 | Cabot Corp. |
| A-172 | filler treatment | 0.86 | Union Carbide Corp. |
| Parapol 2500 | lubricant | 5.31 | Exxon Chemicals |
| Profax 6523 PM | polypropylene | 9.55 | Himont, U.S.A. |
| Statac B | tackifier | 7.04 | Reichhold Chemicals |
| Wingtack 10 | tackifier | 4.12 | Goodyear Chemicals |

Figure 2:
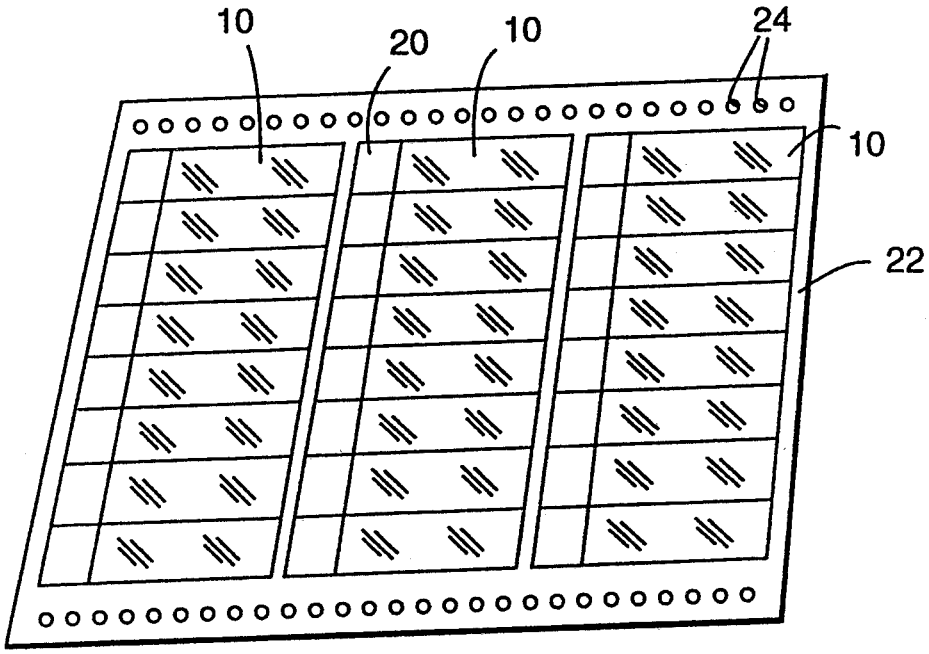
FIG. 2 is a perspective view of a series of the polymeric sheets of FIG. 1 applied to a carrier sheet.

When in use, markers 10 of the invention have suitable imprintable or imprinted area or layer incorporated into the tubular configuration. As seen in FIG. 2, one method of incorporating such an area is by coating a portion of the upper surface of the marker 10 strip with an imprintable layer 20. The portion of the marker 10 may be such that the final position of the imprinted layer 20 is at the inner surface of the final tubular configuration, (having been the first wrap), is at the outer surface of the tubular wall (having been the last wrap) or intermediate the inner and outer surface of the tube. FIG. 2 illustrates a construction where the marker 10 is coated 20 at one end. Using this construction, either of the first two situation may be achieved by wrapping the marker 10 around the object 14 starting with one end of the marker 10 or the other. The imprintable area 20 may be positioned within the wall of the tubular marker 10 by coating an area intermediate the ends of the marker 10. Any location is equally satisfactory, as the transparent polymer allows the identification to be viewed at any position within the tubular wall. It is preferred that the identification be covered by at least the final or outer wrap of the polymeric material to prevent accidental erasure. Most preferably, the coating 20 appears at one end of the upper surface of the polymeric film, and extends approximately 25% of the length of the marker 10, as shown in FIG. 2.

Preferably the area capable of receiving the imprinting 20 is opaque, for maximum contrast and readability. However, a transparent coating 20 may be used where desired. Indeed, the marker 10 may be imprintable in its entirety, such that markings may be made wherever desired prior to application or after. When an additional coating is used to obtain an imprintable area 20, the coating may be a similar or differing polymeric resin as the transparent film. Opacifying fillers such as talc, $TiO_2$, pigments, dyes and the like are useful.

FIG. 2 also illustrates one manner in which a number of markers 10 could be provided for the convenience of the user. A series of markers 10 are provided on a release liner 22 having a series of side holes 24 which make the liner 22 suitable for use in a tractor-feed printer, such as those used with a computer. When supplied in this manner, the imprintable coating 20 may be provided with suitable indicia by the computer printer prior to removal of the marker 10 from the liner 22 and application to the object 14. Of course, indicia must be applied to the coated area 20 before application if it is desired that the indicia be covered with the remainder of the marker 10, but if the marker 10 is wrapped such that the coated area 20 is wrapped last, indicia may be applied after application of the marker 10 to the object 14.

Although the markers 10 are shown in FIG. 2 as being supplied attached to a sheet specifically designed for use with a computer, many other configurations are possible. The markers 10 could be supplied, for example, in a roll, with a liner between convolutions, on a sheet without side holes or in book form wherein a number of sheets are stacked.

If the markers 10 are to be provided as a sheet on a liner 22, the markers 10 must be capable of adhering to the liner 22. This adhesion may be provided by an inherent tackiness of the polymer used, an additive therein, or a coating of heat-sensitive or pressure-sensitive adhesive.

Many various heat-sensitive adhesives may be used, including but not limited to epoxies, silicones, acrylics, rubbery block copolymer adhesives, polyesters, polyolefins and the like. Examples of suitable adhesives include those available from Shell Chemical Company under the trademarks, Kraton TM, those available from Firestone Tire and Rubber under the trade names Stereon TM and "NFA", from B. F. Goodrich under the tradenames "Estane", Hycar TM and Hypalon TM from DuPont under the tradename "Hytrel", from Minnesota Mining and Manufacturing Company, hereinafter "3M", under the tradenames, "Isotac", Scotch TM, and the like.

Preferred pressure-sensitive adhesives are acrylic adhesives. They can be monomers and/or oligomers such as acrylate, acrylamides, methacrylates, methacrylamides, vinyl pyrrolidone and azlactones, as disclosed in U.S. Pat. No. 4,304,705. Such monomers include mono-, di-, or poly-acrylates and methacrylates.

Preferred acrylates are typically alkyl acrylates, preferably monofunctional unsaturated acrylate esters of non-tertiary alkyl alcohols, the alkyl groups of which have from 1 to about 14 carbon atoms. Included with this class of monomers are, for example, isooctyl acrylate, isononyl acrylate, 2-ethyl-hexyl acrylate, decyl acrylate, dodecyl acrylate, n-butyl acrylate, and hexyl acrylate. The alkyl acrylate monomers can be used to form homopolymers or they can be copolymerized with polar copolymerizable monomers selected form strongly polar monomers such as monoolefinic mono- and dicarboxylic acids, hydroxyalkyl acrylates, cyanoalkyl acrylates, acrylamides or substituted acrylamides, or from moderately polar monomers such as N-vinyl pyrrolidone, acrylonitrile, vinyl chloride or diallyl phthalate. The strongly polar monomer preferably comprises up to about 25%, more preferably up to about 15%, of the polymerizable monomer composition. The moderately polar monomer preferably comprises up to about 30%, more preferably from about 5% to about 30% of the polymerizable monomer composition.

The acrylate pressure-sensitive adhesive also contains initiator to aid in polymerization of the monomers. Suitable initiators include such as thermally-activated initiators such as azo compounds, hydroperoxides, peroxides, and the like, and photoinitiators such as the benzoin ethers.

The acrylate pressure-sensitive adhesive matrix may also be cross-linked. Preferred crosslinking agents for the acrylic pressure-sensitive adhesive matrix are multiacrylates such as 1,6-hexanediol diacrylate as well as those disclosed in U.S. Pat. No. 4,379,201 (Heilmann et al.), incorporated herein by reference, or any of the triazine crosslinkers taught in U.S. Pat. Nos. 4,330,590 (Vesley), and 4,329,384 (Vesley et al.), both of which are incorporated by reference. Each of the crosslinking agents is useful in the range of from about 0.01% to about 1% of the total weight of the monomers.

Useful materials which can be blended into any pressure-sensitive adhesive used include, but are not limited to, fillers, pigments, plasticizers, tackifiers, fibrous reinforcing agents, woven and nonwoven fabrics, foaming agents, antioxidants, stabilizers, fire retardants, and rheological modifiers, so long as such additions do not adversely affect the readability and dimensional stability of the final article.

Figure 3:
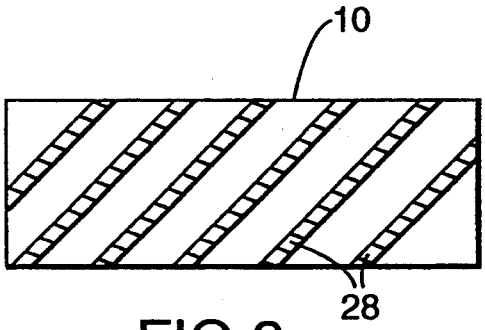
FIG. 3 is a plan view of the underside of a polymeric sheet of the invention with an adhesive applied thereto.

If an adhesive is necessary it is important that it be coated on only a small portion of the film, preferably 25% or less, or that the adhesive be applied in a pattern which will attach all portions of the marker 10 to the liner 22, but which will provide open spaces to allow the self-fusing material of the marker 10 to contact itself as the marker 10 is wrapped around the object 14 to be identified. One useful pattern is shown in FIG. 3, wherein the adhesive 28 is applied as a series of stripes to the marker 10. Any pattern of adhesive 28, such as transverse or longitudinal stripes, a diamond pattern, dots or irregular lines could be used so long as sufficient area of the marker 10 material remains open for contact with itself when overwrapped.

The pressure-sensitive adhesive 28 need not be provided if the marker 10 is inherently capable of adherence. This is easily accomplished by the addition of a suitable tackifier. Tackifiers useful in articles of the invention have softening temperatures of from about 65° C. to about 110° C., and do not degrade or substantially inhibit the fusion of the marker 10. Further, useful tackifiers do not affect the clarity of the polymeric resin either initially or after heating.

Suitable tackifiers include hydrogenated rosin esters. Ethylene glycol, glycerol, and pentaerythritol are the most common alcohols used for esterification. Rosin esters are quite stable and resistant to hydrolysis. Preferred tackifiers are highly hydrogenated, such as those available from companies such as Hercules, Inc., under such tradenames as Foral TM 65, Foral TM 85, Piccolyte TM, Pentalyn TM, and the like.

The marker 10 is used by inscribing suitable marks or indicia in the imprintable area 20. The end of the marker 10 closest to the now imprinted area 20 is then placed against the elongate object 14, with the lower uncoated surface of the marker 10 in contact with the object 14. The marker 10 is wound around the elongate object 14, overwrapping itself, so that a multilayer tubular structure is formed. The marker 10 will self-adhere without undue finger pressure or tension being applied. This self-adhesion will be sufficient to hold the tail of the marker 10 in place temporarily. The strip may be peeled from the elongate article at this point, and repositioned, if desired.

Once applied, the marker 10 article is rendered permanently attached by allowing the marker 10 to remain relatively undisturbed for a period of several minutes to several days, depending upon the formulation used. During and after fusion, the marker 10 retains its transparency such that the indicia are readable even though the ink receptive area is covered and protected by several wraps. The rigidity of attachment, and thickness of the tubular wall is influenced by the wrapping technique used. If tightly wound, the tubular article will move longitudinally only with great difficulty, and will have thicker walls, produced by more overwraps. If more loosely wound, the tubular article will move along the elongate object 14 with ease.

We claim:

1. A permanent marking article for use with an elongate object, comprising a sheet of transparent film consisting of a polymer selected from the group consisting of uncured EPDM, partially cured EPDM, Fully cured EPDM, uncured self-fusing silicone gum, partially cured self-fusing silicone gum, fully cured self-fusing silicone gum, nitrile and mixtures thereof, said film having an upper and a lower surface, at least a portion of the upper surface being imprintable, said polymeric film further being capable of self-adherence and fusible to itself in the relaxed state with the passage of time in the absence of applied heat, said marking article remaining transparent after fusion such that any marking placed on any portion of the article remains readable even if covered by one or more overwrapping portions of said sheet.

2. A marking article according to claim 1 wherein a portion of the upper surface is coated with an opaque, imprintable layer.

3. A marking article according to claim 1 wherein a portion of said lower surface has been coated with a pressure-sensitive adhesive.

4. A marking article according to claim 3 wherein said pressure-sensitive adhesive covers no more than 25% of said lower surface of said polymeric strip.

5. A permanent marking article according to claim 5 wherein said adhesive is selected from the group consisting of silicones, acrylics, elastomeric block copolymer adhesives, polyesters, and polyolefins.

6. A permanent marking article according to claim 5 wherein said adhesive is an acrylic adhesive.

7. A kit comprising a multiplicity of permanent marking articles according to claim 1 releaseably attached to a liner.

* * * * *

UNITED STATES PATENT AND TRADEMARK OFFICE

CERTIFICATE OF CORRECTION

PATENT NO. : 5,366,575
DATED : November 22, 1994
INVENTOR(S) : Karen E. Staff and James M. Scott It is certified that error appears in the above-indentified patent and that said Letters Patent is hereby corrected as shown below:

It is certified that error appears in the above-identified patent and that said Letters Patent is hereby corrected as shown below:

Column 8, Line 26, "according to claim 5" should read -- according to claim 4 --.

Signed and Sealed this

Twenty-eight Day of February, 1995

*Attest:*

*Attesting Officer*

BRUCE LEHMAN

*Commissioner of Patents and Trademarks*